US011377863B1

(12) United States Patent
Friesen et al.

(10) Patent No.: US 11,377,863 B1
(45) Date of Patent: Jul. 5, 2022

(54) AGGREGATE PANEL SYSTEM

(71) Applicant: Predl Systems North America Inc., Burnaby (CA)

(72) Inventors: Jed Christopher Friesen, Vancouver (CA); Andrew Jackman, Pitt Meadows (CA)

(73) Assignee: Predl Systems North America Inc., Burnaby (CA)

( * ) Notice: Subject to any disclaimer, the term of this patent is extended or adjusted under 35 U.S.C. 154(b) by 0 days.

(21) Appl. No.: 17/096,881

(22) Filed: Nov. 12, 2020

Related U.S. Application Data

(60) Provisional application No. 62/934,958, filed on Nov. 13, 2019.

(51) Int. Cl.
*E04G 23/02* (2006.01)
*E03B 11/14* (2006.01)

(52) U.S. Cl.
CPC ..... *E04G 23/0229* (2013.01); *E03B 11/14* (2013.01); *E04G 2023/0251* (2013.01)

(58) Field of Classification Search
CPC ..... E04G 23/0229; E04G 2023/0251; E04G 23/02; E04G 23/028; E03B 11/14; E04B 2/842; E04B 2/8611; E04B 2/8635; E04B 1/043; E04B 1/046
See application file for complete search history.

(56) References Cited

U.S. PATENT DOCUMENTS 541,987 A 7/1895 Whiteside
1,712,510 A 5/1929 Monie
1,955,018 A 4/1934 Rego
2,025,839 A 12/1935 Woods
2,030,536 A 2/1936 Rego
2,239,033 A 4/1941 Cartmill
2,254,668 A 9/1941 Tomek
(Continued)

FOREIGN PATENT DOCUMENTS

DE 817419 C 10/1951
EP 0685607 A1 12/1995
(Continued)

OTHER PUBLICATIONS

Fernco Inc., "Fernco Saddle", https://www.google.ca/search?q=fernco+saddle&client=safari&hl=en-ca&prmd=sivn&source=lnms&tbm=isch&sa=X&ved=2ahUKEwibgZ2dhPLkAhXWsJ4KHaosDjkQ_AUoAnoECA4QAg&biw=375&bih=635&dpr=3, accessed Sep. 27, 2019, 3 pages.
(Continued)

*Primary Examiner* — Theodore V Adamos
(74) *Attorney, Agent, or Firm* — Schacht Law Office, Inc.; Dwayne Rogge

(57) ABSTRACT

An aggregate panel system comprising in one example: a rigid first panel having: a first side comprising a fluid impermeable, non-porous outer layer; a second side facing a first base wall to which the first panel is attached. Also disclosed is at least one optional panel brace fixed to the second side of the first panel and extending toward the base wall, the panel brace configured to increase rigidity of the first panel. An aggregate fill (e.g. concrete) is then poured or otherwise disposed between the first panel and the first base wall to fill the region therebetween. The aggregate fill configured to harden to a solid aggregate fill and thus structurally support both the base wall and the rigid panel.

13 Claims, 2 Drawing Sheets

(56) References Cited

U.S. PATENT DOCUMENTS

| | | | | |
|---|---|---|---|---|
| 2,620,749 | A | 12/1952 | West | |
| 2,681,494 | A | 6/1954 | Weber | |
| 2,689,687 | A * | 9/1954 | Franjetic | E01B 3/34 238/79 |
| 3,090,160 | A | 5/1963 | Shaver et al. | |
| 3,321,884 | A * | 5/1967 | Klaue | E04C 2/34 52/565 |
| 3,331,295 | A | 7/1967 | Sorrell | |
| 3,370,386 | A | 2/1968 | Martin | |
| 3,462,896 | A | 8/1969 | Lokensgaard | |
| 3,477,106 | A | 11/1969 | Tetzlaff et al. | |
| 3,533,199 | A | 10/1970 | Pickett | |
| 3,715,958 | A | 2/1973 | Crawford et al. | |
| 3,745,738 | A | 7/1973 | Singer | |
| 3,787,078 | A | 1/1974 | Williams | |
| 3,938,285 | A | 2/1976 | Gilbu | |
| 3,965,233 | A | 6/1976 | Ritter | |
| 4,030,694 | A * | 6/1977 | Schimmel | E04G 11/087 249/196 |
| RE29,636 | E | 5/1978 | Gilbu | |
| 4,102,088 | A | 7/1978 | Keller et al. | |
| 4,119,291 | A | 10/1978 | Polito | |
| 4,123,033 | A | 10/1978 | Joelson | |
| 4,127,990 | A | 12/1978 | Morrow | |
| 4,275,757 | A | 6/1981 | Singer | |
| 4,318,880 | A | 3/1982 | McIntosh et al. | |
| 4,346,921 | A | 8/1982 | Gill et al. | |
| 4,372,017 | A | 2/1983 | Heckethom | |
| 4,419,231 | A | 12/1983 | Friedl | |
| 4,422,994 | A | 12/1983 | Ditcher | |
| 4,472,911 | A | 9/1984 | Jooris et al. | |
| 4,591,290 | A | 5/1986 | Prescott | |
| 4,621,941 | A | 11/1986 | Ditcher et al. | |
| 4,682,907 | A | 7/1987 | Gaudin | |
| 4,751,799 | A | 6/1988 | Ditcher et al. | |
| 4,776,138 | A | 10/1988 | Sumner et al. | |
| 4,776,722 | A | 10/1988 | Gaudin | |
| 4,927,290 | A | 5/1990 | Bowman | |
| 5,017,313 | A | 5/1991 | Trimble | |
| 5,032,197 | A | 7/1991 | Trimble | |
| 5,081,802 | A | 1/1992 | Westhoff et al. | |
| 5,100,697 | A | 3/1992 | Nielsen | |
| 5,261,766 | A | 11/1993 | Anderson | |
| 5,263,298 | A | 11/1993 | Ballesteros | |
| 5,271,518 | A | 12/1993 | Webb | |
| 5,303,518 | A | 4/1994 | Strickland | |
| 5,308,192 | A | 5/1994 | Srackangast | |
| 5,360,131 | A | 11/1994 | Phillipps et al. | |
| 5,386,669 | A | 2/1995 | Almeida | |
| 5,413,307 | A | 5/1995 | Tidwell | |
| 5,451,081 | A | 9/1995 | Kaucnik | |
| 5,536,420 | A | 7/1996 | Oyzboyd | |
| 5,549,411 | A | 8/1996 | Hawkins | |
| 5,564,860 | A | 10/1996 | Amann | |
| 5,735,082 | A | 4/1998 | Lecuyer et al. | |
| 5,885,446 | A | 3/1999 | McGrew, Jr. | |
| 5,979,117 | A | 11/1999 | Fuller | |
| 6,074,130 | A | 6/2000 | Duran | |
| 6,135,141 | A | 10/2000 | Bombach | |
| 6,202,370 | B1 | 3/2001 | Miller et al. | |
| 6,266,928 | B1 | 7/2001 | Argandona | |
| 6,385,913 | B1 | 5/2002 | Ahn | |
| 6,393,771 | B1 | 5/2002 | Stetson | |
| 6,428,701 | B1 | 8/2002 | Mullennix et al. | |
| 6,457,901 | B1 | 10/2002 | Sondrup | |
| 6,613,228 | B2 | 9/2003 | Petersen et al. | |
| 6,746,178 | B1 | 6/2004 | Hensley et al. | |
| 6,851,225 | B1 | 2/2005 | Haar et al. | |
| 7,144,189 | B1 | 12/2006 | Bongiovanni et al. | |
| 7,347,644 | B2 | 3/2008 | Meyers | |
| 7,473,373 | B1 | 1/2009 | Danler | |
| 7,695,213 | B1 | 4/2010 | Akkala et al. | |
| 7,748,926 | B2 | 7/2010 | Jurich et al. | |
| 8,479,469 | B2 * | 7/2013 | Ciccarelli | E04B 2/8635 52/426 |
| 8,851,789 | B2 | 10/2014 | Bax | |
| 9,011,035 | B2 | 4/2015 | Munro | |
| 9,175,705 | B1 | 11/2015 | Clark, Jr. et al. | |
| 9,890,513 | B1 | 2/2018 | Wu et al. | |
| 10,022,825 | B2 * | 7/2018 | Richardson | E04F 19/062 |
| 10,138,615 | B2 | 11/2018 | Kim et al. | |
| 10,214,893 | B2 | 2/2019 | Skinner et al. | |
| 10,294,627 | B2 | 5/2019 | Bechler et al. | |
| 10,344,447 | B2 | 7/2019 | Sauve et al. | |
| 10,370,181 | B1 | 8/2019 | Plummer | |
| 10,428,548 | B2 | 10/2019 | Yano | |
| 10,436,374 | B2 | 10/2019 | Kiest, Jr. | |
| 10,442,617 | B1 | 10/2019 | Holbrook | |
| 10,458,093 | B2 | 10/2019 | Gilbert | |
| 10,563,373 | B1 | 2/2020 | Friesen | |
| 10,662,606 | B1 | 5/2020 | Friesen | |
| 10,689,834 | B2 | 6/2020 | Levesque | |
| 10,822,766 | B1 | 11/2020 | Friesen | |
| 10,961,681 | B2 | 3/2021 | Friesen | |
| 10,968,594 | B1 | 4/2021 | Friesen | |
| 2004/0081517 | A1 | 4/2004 | Hartman | |
| 2005/0000175 | A1 | 1/2005 | Machledt et al. | |
| 2005/0100412 | A1 | 5/2005 | Houck | |
| 2006/0065994 | A1 | 3/2006 | Zotto | |
| 2007/0053747 | A1 | 3/2007 | O'Brien | |
| 2011/0013991 | A1 | 1/2011 | Watson et al. | |
| 2011/0203192 | A1 | 8/2011 | Schneider et al. | |
| 2012/0141210 | A1 | 6/2012 | Kiest, Jr. | |
| 2012/0159883 | A1 * | 6/2012 | Dayton | E04F 13/0864 52/309.1 |
| 2012/0233950 | A1 * | 9/2012 | Carr | E04C 3/34 52/426 |
| 2013/0336723 | A1 | 12/2013 | McKinney et al. | |
| 2016/0097180 | A1 | 4/2016 | Pesonen | |
| 2016/0145848 | A1 | 5/2016 | Skinner et al. | |
| 2017/0107714 | A1 * | 4/2017 | Connell | E04F 19/026 |
| 2017/0369236 | A1 * | 12/2017 | Goad | B29C 65/525 |
| 2018/0305888 | A1 | 10/2018 | Bonell et al. | |
| 2019/0145091 | A1 | 5/2019 | Skinner et al. | |
| 2020/0217037 | A1 | 7/2020 | Friesen | |
| 2020/0399913 | A1 * | 12/2020 | Amend | E04B 2/8647 |
| 2021/0214914 | A1 | 7/2021 | Friesen | |

FOREIGN PATENT DOCUMENTS

| | | | | |
|---|---|---|---|---|
| EP | 0737617 | A1 | 10/1996 | |
| EP | 2604758 | B1 | 4/2014 | |
| FR | 2897378 | A1 * | 8/2007 | E04H 4/0081 |
| GB | 2145444 | B | 4/1988 | |
| JP | 0726408 | A | 3/1995 | |
| JP | 408333763 | A | 12/1996 | |
| JP | 2006090047 | A | 4/2006 | |
| JP | 2014077249 | A | 5/2014 | |
| JP | 2016145484 | A | 8/2016 | |
| JP | 2017197941 | A | 11/2017 | |
| WO | 2018011812 | A1 | 1/2018 | |

OTHER PUBLICATIONS

National Liner, "The 3S Segment Panel System: Taking Trenchless Pipeline Rehabilitation . . . From Evolutionary to Revolutionary", https://www.nationalliner.com/portals/0/pdf/3-pannel-system.pdf, accessed Nov. 16, 2019, 4 pages.

National Precast Concrete Association, "Watertight Manhole Joints," Jun. 2013, 4 pages.

* cited by examiner

AGGREGATE PANEL SYSTEM

RELATED APPLICATIONS

This application claims priority of U.S. Provisional Patent Application Ser. No. 62/934,958 filed on Nov. 13, 2019 incorporated herein by reference.

BACKGROUND OF THE DISCLOSURE

Field of the Disclosure

This disclosure relates to the field of rigid panels cast in place against an existing base wall. The panel system cast against the base wall to optionally provide corrosion protection and structural support to the base wall.

BRIEF SUMMARY OF THE DISCLOSURE

Disclosed herein is an aggregate panel system comprising in one example: a rigid first panel having: a first side comprising a fluid impermeable, non-porous outer layer; a second side facing a first base wall to which the first panel is attached. Also disclosed is at least one optional panel brace fixed to the second side of the first panel and extending toward the base wall, the panel brace configured to increase rigidity of the first panel. An aggregate fill (e.g. concrete) is then poured or otherwise disposed between the first panel and the first base wall to fill the region therebetween. The aggregate fill configured to harden to a solid aggregate fill and thus structurally support both the base wall and the rigid panel.

When hardened, the solid aggregate fill is mechanically bonded to the first panel and also mechanically bonded to the first base wall. When a panel brace is fitted to the first panel, the solid aggregate fill is also mechanically bonded to the panel brace.

To ensure that the first panel is properly and securely offset from the base wall; a plurality of panel offsets may be provided. The panel offsets extending from the first panel to the base wall and attached thereto via fasteners, adhesives, welding, or combinations thereof.

The aggregate panel system may be arranged wherein the second side of the first panel facing the base wall comprises a rigid layer. This rigid layer may be formed of metals, natural materials (wood, bamboo etc.) fiber reinforced plastic such as fiberglass or carbon fiber infused with hardened resin or epoxy, and equivalents.

The aggregate panel system may be arranged wherein the panel offsets are monolithic with the first panel. The term monolithic used herein as: cast as a single piece; formed or composed of material without joints or seams; consisting of or constituting a single unit; constituting an undifferentiated and rigid whole. In one example, these panel offsets are fixed to the base wall by adhesives, welding, or fasteners passing through the panel offsets and fastened to the base wall.

Often it may be desired to seal the first panel at the edges thereof to the base wall, to a base (floor) or to adjacent adjoining panels. Thus, in one example may be attached the first side of the first panel comprising a weldable perimeter face edge.

When the first panel is not large enough to cover the desired area, the aggregate panel system may comprise a rigid second panel immediately adjacent the first panel. In one example the second panel is parallel to the first panel. In other examples the second panel is angled relative to the first panel. In one example the second panel is attached to a second base wall. The second panel comprising a weldable perimeter edge similar to the weldable perimeter edge of the first panel. To attach the first panel to the second panel, an overlap panel may be provided. The overlap panel may be welded or otherwise sealed to the perimeter edge of both the first panel and the second panel to seal the gap therebetween.

In locations where a pipe fixture is in the base wall, the aggregate panel system may further comprise a pipe fitting sealed to the first panel. The pipe fitting forming a void through the first panel to the base wall; and the pipe fitting forming a conduit to a plumbing fixture extending into the base wall.

To ensure that the base wall nor the aggregate fill nor the panel are deteriorated by nor permeated by fluids, including corrosive fluids, in one example the first panel comprises a corrosion-resistant inner surface. In one example, this corrosion resistant inner surface comprises a hardened polymer such as: polypropylene; fiber reinforced plastic, equivalents.

DETAILED DESCRIPTION OF THE DISCLOSURE

Figure 1:
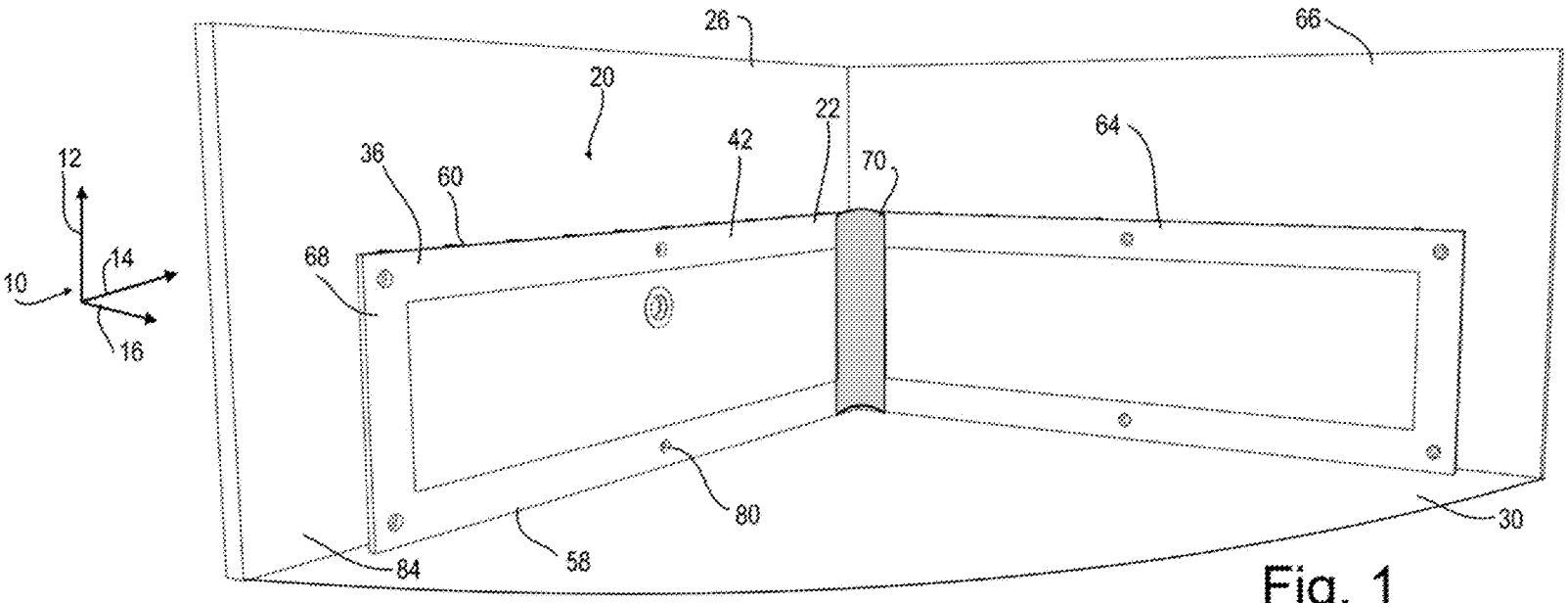
FIG. 1 is a perspective environmental view of the disclosed aggregate panel system.

In the field of base walls used in the construction of structures such as manholes, vaults, rooms, storage spaces, and other fluid conduit and holding tank structures, great advances have been made to improve efficiency, reduce problems, reduce leakage into and out of fluid systems, and to improve the longevity of fluid conveying and holding systems.

In this disclosure, for ease in description, the term "vault" will be used to describe all these structures and equivalents.

Historically, a great number of base walls of such vaults have been installed which have deteriorated, are expected to deteriorate, or are prone to leakage and failure. In many instances, these problematic base walls need to be repaired or replaced, often with the cost of replacement less than the cost of repair using previously known techniques.

To provide a relatively quick, easy, inexpensive, dependable repair, the aggregate panel system 20 having a corrosion resistant layer 22 is herein disclosed. Such an aggregate panel system 20 may be used to structurally reinforce and add corrosion resistance to an existing vault 24 or other fluid structure formed with a base wall 26. In some instances, the disclosed aggregate panel system 20 may be utilized interior of an existing vault 24.

In many examples, a pipe fixture 28 such as a cross-pipe, inlet pipe, outlet pipe, or equivalent extends through the inner surface of the base wall 26. This pipe fixture 28 may in some applications be a section of pipe which has been cut off to enable installation of the aggregate panel system 20.

In other applications it may be a pipe, bell housing, pipe fitting, pipe bell, pipe valve, or other equivalent apparatus.

The term vault used herein encompasses many different structures including structures forming a substantially enclosed chamber extending from a base 30 generally upward to a ground level. Commonly a vault 24 comprises a base 30, one or more base walls 26 extending upward from the base 30, and often a cover 32. The vault may also include a cover cap 34 which is commonly removable from the vault 24 to allow access to the vault 24. In many instances the vault 24 is large enough to fit an adult person may then enter the vault 24 to access the pipe fixture 28 and other components of the vault 24 for inspection, cleaning, or repair. Where the cover 32 in some examples is called a manhole and is the component normally seen by most people the term manhole has become synonymous with the manhole cover but the distinction is intended herein between the components forming the vault 24 and the cover cap 34.

Looking to FIG. 1 is shown one example of an aggregate panel system 20 attached to a first base wall 26. This example of the aggregate panel system 20 comprises a first panel 42 having a first side 36. The first side 36 comprising a corrosion resistant liner 22. The corrosion resistant liner 22 forming a physical/chemical barrier between fluids (liquids and gasses) within the vault 24 and the first base wall 26. Thus, the corrosion resistant liner 22 provides corrosion and fluid intrusion protection to the base wall 26. This corrosion resistant liner 22 may comprise a hardened polymer such as: polypropylene; fiber reinforced plastic, gel coat, polyvinylchloride, copper or other metals, natural materials, glass, and equivalents.

The second side 38 of the first panel 42 may be formed of fiber reinforced plastic (FRP) such as fiberglass (FRP), carbon fiber, bamboo, or other fibers infused with a volume of hardened epoxy, polyurethane resin, or equivalents. In one example the second side 38 is formed by known fiberglass layup techniques on a mold and the first side 36 is molded thereon. In another example the first side 36 is molded on a mold and the second side 38 is formed by known fiberglass layup techniques on the first side 36.

The second side 38 of the panel 42 may be offset from the base wall 26 by a gap, forming a space 40. During construction a volume of aggregate material 44 is poured in fluid form into this space 40. The fluid aggregate material 44 thus filing the space 40 as it flows therein, the ends of the panel 42 may be sealed to the base wall 26 or other structures to keep the fluid aggregate in place, and the bottom edge 58 may be sealed to an adjacent structure such as the base 30. As the aggregate material 44 cures/hardens to a hardened or solid state, the aggregate material 44 may mechanically/physically bond to the second side 38 of the first panel 42 and may simultaneously mechanically/physically bond to the base wall 26. The hardened aggregate material thus structurally reinforcing and sealing both the base wall 26 as well as the first panel 42.

Where the second side of the first panel 42 is not smooth, such as unfinished FRP, the aggregate 44 may bond sufficiently without additional attachment needed. In other applications it may be desired to increase the structural rigidity of the panel 42 and to increase the mechanical bond to the aggregate 44. In such applications one or more offset struts 46 may be attached to the first panel 42 or formed monolithic thereto.

In one example shown in the figures, each offset strut 46 comprises one or more surfaces 48 defining voids 50 therethrough. Such a permeated structure increases the structural rigidity of the strut 46, reduces overall weight relative to a solid strut 46, and increases the mechanical bond to the aggregate 44 as the fluid aggregate 44 fills each void 50 and hardens in this position.

Before continuing, an axes system 10 is defined herein for ease in description. This axes system used to assist in describing the components relative the drawings shown. It is understood that the orientation of the structures may be varied to other orientations. For example, the first panel 42 may be arranged flat to cover a floor or ceiling, or any angles shown or not shown. The axes system not intended as a limiting orientation of the claimed invention. The axes system 10 including a vertical axis 12 orthogonal to the base 30, and a longitudinal axis 14 orthogonal to the vertical axis 12. The longitudinal axis 14 in this example is parallel to the first base wall 26.

Figure 6:
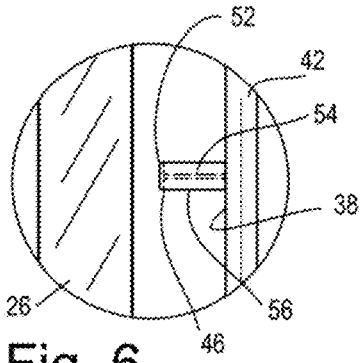
FIG. 6 is an enlarged hidden line view of the region 6 of FIG. 3.

The offset struts 46 in one example extend away from the second side 38 of the first panel 42 toward the base wall 26 and thus will engage the aggregate fill 44. As shown in FIG. 6, the offset struts 46 may each comprise an end plate 52 at the distal (transverse) end of the offset strut 46. Each end plate 52 may be formed monolithic with the web 54 of the offset strut 46 forming the voids 50. The end plate 52 is configured to increase the structural rigidity of each offset strut 46 and increase the mechanical bond to the aggregate 44. In one example each offset strut 46 comprises one or more transverse plates 56 extending from the second side 38 of the first panel 46 to the end plate 52. The transverse plate 56 also increasing the structural rigidity of the offset strut 46.

In the example shown the offset struts 46 are orientated vertically and extend substantially from the bottom edge 58 of the panel 42 substantially to the upper edge 60. Thus, the aggregate should be poured into the space 40 between each adjacent pair of struts 46, although some of the aggregate 44 may travel through the voids 50 in each strut when provided.

In one example each of the offset struts 46 may be cast prior to casting/forming the planar portion of the first panel 42. They may then be cast or formed to the planar portion of the first panel 42 or adhered thereto during construction. Once constructed, the struts 46 may form a monolithic structure of the first panel 42.

The offset struts 46 in one example do not extend transversely 16 to contact the first base wall 26. This allowing the aggregate 44 to flow longitudinally 14 between adjacent spaces 40 separated by an offset strut 46. In addition, this gap 62 helps to maintain a planar first side 36 of the panel 42 where the base wall 26 may not be perfectly flat. The gap 62 keeping the offset struts 46 from transmitting the defect to the front or first side 36.

Wherein the first panel 42 by itself may not be sufficient to cover the first base wall 26, or where it may be desired to seal the first panel 42 to a second panel 64, to the base 30, to a second base wall 66, or to other components, the first panel 42 may comprise a weldable perimeter edge 68. In one example the second panel 64 is similar, or identical in structure to the first panel 42 and thus all components of the first panel 42 may be provided on the second panel 64 and other panels. This weldable perimeter edge 68 may be on one side or more than one side as needed. The term weldable based on the term weld which as used herein means to unite or fuse (as pieces of metal) by hammering, compressing, heating, chemical bonding, or the like, especially after rendering soft or pasty by heat, or chemicals, and sometimes with the addition of fusible material like or unlike the pieces to be united.

In this example, the weldable edges 68 of adjacent components, such as the panel 42 and the base 30 or the adjacent second panel 64 (also having a weldable edge) may be attached and sealed to prevent corrosion and fluid seepage therebetween the components.

In the example shown in FIG. 1, adjacent weldable edges 68 of the first panel 42 and a second panel 64 are connected and sealed to each other. In one example this is accomplished via a weldable panel or corner 70. This weldable panel 70 having a surface which is configured to be heat welded, chemically welded, or otherwise sealed to each of the weldable edges 68. Such a weldable panel 70 may extend across one seam as shown or may extend across multiple seams if desired. In one example the weldable panel 70 is pliable, to seal against a non-planar seam. The weldable panel 70 may comprise the same material as the first side 36 of the panel 42.

Figure 3:
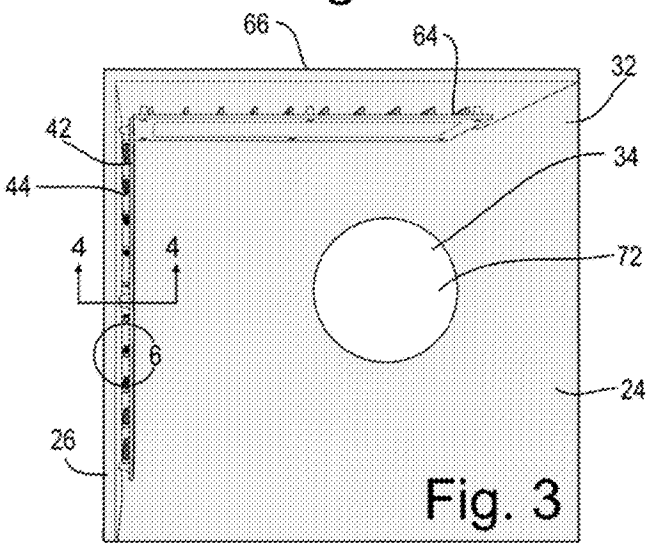
FIG. 3 is a top perspective view of the disclosed aggregate panel system.
Figure 2:
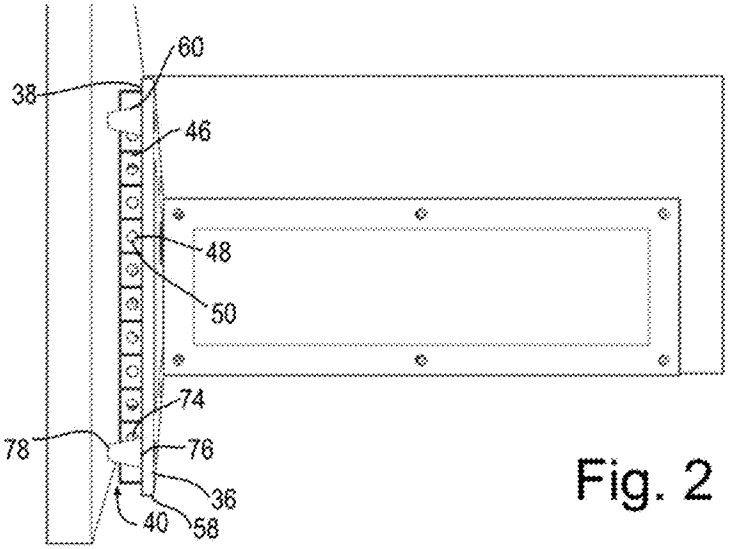
FIG. 2 is an end perspective view of the disclosed aggregate panel system.
Figure 4:
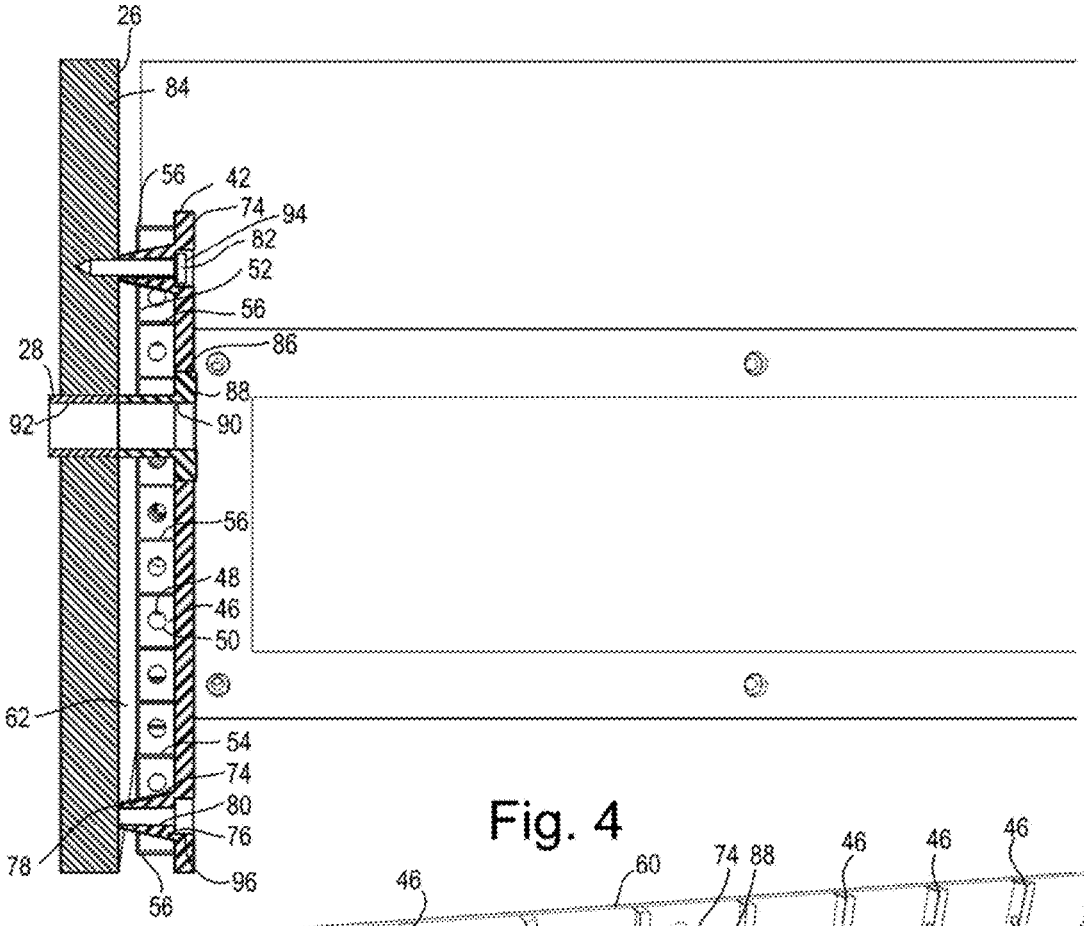
FIG. 4 is an end cutaway view taken along line 4-4 of FIG. 3.
Figure 5:
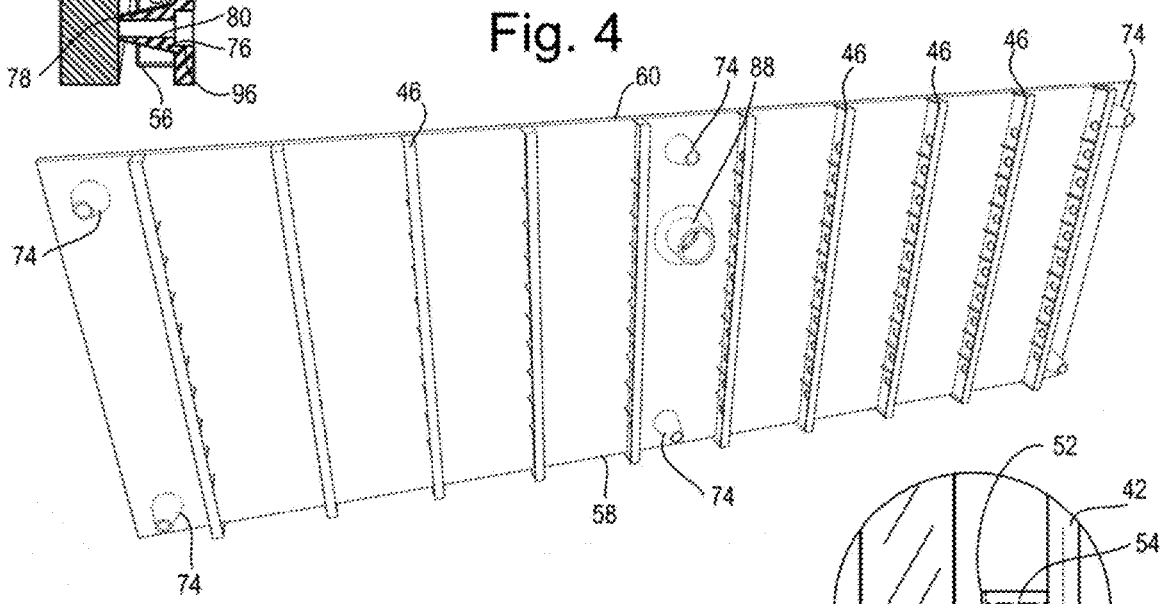
FIG. 5 is a rear view of a panel as shown in FIG. 1 prior to attachment to a base wall.

In some examples, it may be needed or desired for the first panel 42 to be substantially smaller than the base wall (base walls 26/66 for example). For example, in the vault 24 shown in FIG. 3 it may not be possible to fit a panel 42/64 through the relatively small opening 72 in the cover 32. Thus, each base wall 26/66 etc. may require several panels 44/64 for proper coverage. By providing smaller panels 42/66 on each base wall, installation and pouring of aggregate 44 is easily accomplished in smaller steps.

To ensure proper spacing between the second side 38 of the first panel 42 and the base wall 26, one or more panel offsets 74 may be attached to the panel 42 or formed as monolithic structure(s) of the panel 42. These panel offsets 74 may be slightly longer in the transverse direction than the offset struts 46 as previously described.

In one example, the panel offsets 74 have a first end 76 coupled to the second side 38 of the panel 42 and extending therefrom to a second end 78 in contact with, attached to, or formed with the base wall 26. The second end 78 may be attached to the base wall 26 via adhesives, welding, or mechanical fasteners including screws, bolts, nails, etc.

The panel offsets 74 in one example having a surface defining a transverse conduit 80 there though for use by a fastener. This conduit 80 allowing passage of a fastener 82 therethrough. The fastener 82 such as a screw, rivet, bolt, or combination thereof is coupled to the base wall 26 and holds the base wall 26 in place at least until the aggregate 44 hardens, thus mechanically boding the first panel 42 to the base wall 26. In one example, the head 94 of the fastener is recessed into a recess 96 in the panel 42 and/or in the conduit 80. In one example the conduit 80 is tapered or stepped to allow partial passage of the head of the fastener.

As previously mentioned, the base wall 26 may include a pipe fixture 28 or similar fluid structure forming a fluid conduit through the inner surface 84 of the base wall 26. To ensure a secure fluid connection and sealed conduit through the first panel 42. Thus, a surface defining a void 86 may be established though the first panel 42, this void 86 is substantially aligned with the pipe fixture 28. In one example, this void 86 is formed in the panel 42 prior to attachment of the panel 42 to the base wall 26.

During assembly, the pipe fitting 88 is sealed to the first panel 42 and also sealed to the pipe fixture 28 such that the inner surface 90 of the pipe fitting and inner surface 92 of the pipe fixture form a fluid conduit through which fluid may flow without leaking out of the fluid conduit into the base wall 26, aggregate 44, panel 42, or into the vault 24. The pipe fitting 88 may be a bell housing, bell, spigot, valve, pipe section, or other fitting securely connectable to the pipe fixture 28 and to another conduit or pipe fixture not shown. The pipe fitting may be sealed as a butt joint or may be sealed around the exterior of the pipe fixture 28 or interior of the pipe fixture 28.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. An aggregate panel system comprising:

a first base wall of an existing vault;

the aggregate panel system configured to attach to, reinforce, and seal the first base wall;

a rigid first panel having: a first side comprising a fluid impermeable, non-porous outer layer; a second side facing the first base wall of the existing vault to which the first panel is attached, and a plurality of perimeter edges;

at least one rigid panel brace fixed to and extending from the second side of the first panel offset from the perimeter edges and extending toward the base wall;

each panel brace configured to increase rigidity of the first panel;

a gap between each panel brace and the base wall;

an aggregate fill configured to be poured into a space between the first panel, each panel brace, and the first base wall to fill the space therebetween;

the aggregate fill configured to harden to a solid aggregate fill;

the aggregate fill configured to be mechanically bonded to the first panel when hardened and mechanically bonded to the first base wall;

the aggregate fill configured to be mechanically bonded to the panel brace when hardened;

a plurality of panel offsets fixed to and extending from the first panel to the base wall and attached thereto;

the panel offsets each comprising a surface defining a transverse conduit therethough;

each transverse conduit configured for passage of a fastener therethrough; and each fastener coupled to the base wall and configured to attach the first panel to the base wall.

2. The aggregate panel system as recited in claim 1 wherein the second side of the first panel comprises a rigid layer.

3. The aggregate panel system as recited in claim 2 wherein the rigid layer comprises fiber reinforced plastic.

4. The aggregate panel system as recited in claim 1 further comprising a weldable perimeter edge.

5. The aggregate panel system as recited in claim 4 further comprising:

a rigid second panel immediately adjacent the first panel;

the second panel comprising a weldable perimeter edge; and an overlap panel welded to the perimeter edge of both the first panel and the second panel to seal a gap therebetween.

6. The aggregate panel system as recited in claim 5 wherein the second panel is parallel to the first panel.

7. The aggregate panel system as recited in claim 1 further comprising:

a pipe fitting sealed to the first panel;

the pipe fitting forming a void through the first panel to the base wall; and the pipe fitting forming a conduit to a plumbing fixture extending into the base wall.

8. The aggregate panel system as recited in claim 1 comprising a corrosion-resistant inner surface applied to the inner surface of the first panel comprising a different material than the first panel.

9. The aggregate panel system as recited in claim 8 wherein the corrosion resistant inner surface comprises a hardened polymer.

10. The aggregate panel system as recited in claim 9 wherein the hardened polymer comprises polypropylene.

11. The aggregate panel system as recited in claim 9 wherein the hardened polymer comprises fiber reinforced plastic.

12. An aggregate panel system comprising:

a first base wall of an existing vault;

the aggregate panel system configured to attach to, reinforce, and seal the first base wall;

a rigid first panel having: a first side comprising a fluid impermeable, non-porous outer layer; a second side facing the first base wall of the existing vault to which the first panel is attached, and a plurality of perimeter edges;

at least one rigid panel brace fixed to and extending from the second side of the first panel offset from the perimeter edges and extending toward the base wall;

a gap between each panel brace and the base wall;

each panel brace configured to increase rigidity of the first panel;

an aggregate fill configured to be poured into a space between the first panel, each panel brace, and the first base wall to fill the space therebetween;

the aggregate fill configured to harden to a solid aggregate fill;

the aggregate fill configured to be mechanically bonded to the first panel when hardened and in direct contact with the first base wall;

the aggregate fill configured to be mechanically bonded to each panel brace when hardened;

a plurality of panel offsets extending from the first panel to the base wall and attached thereto;

the panel offsets each comprising a surface defining a transverse conduit therethough;

each transverse conduit configured for passage of a fastener therethrough; and each fastener coupled to the base wall and configured to attach the first panel to the base wall.

13. A method for reinforcing an existing vault formed of at least one base wall, comprising the steps of:

providing a rigid first panel having: a first side comprising a fluid impermeable, non-porous outer layer; a second side facing the first base wall to which the first panel is attached, and a plurality of perimeter edges;

providing at least one panel brace extending from the second side of the first panel offset from the perimeter edges and extending toward the base wall so as to form a gap between each panel brace and the base wall;

each the panel brace increasing rigidity of the first panel;

providing a plurality of panel offsets extending from the first panel to the base wall and attaching the plurality of panel offsets thereto;

the panel offsets each comprising a surface defining a transverse conduit therethough;

passing a fastener through each conduit to the base wall;

coupling each fastener directly to the base wall to attach the first panel to the base wall;

pouring an aggregate fill into a space between the first panel and the first base wall to fill the space therebetween;

allowing the aggregate fill to harden to a solid aggregate fill;

the solid aggregate fill mechanically bonded to the first panel when hardened and in direct contact with the first base wall; and the aggregate fill mechanically bonded to each panel brace when hardened.

* * * * *